US007101228B2

(12) United States Patent
Hamner et al.

(10) Patent No.: US 7,101,228 B2
(45) Date of Patent: Sep. 5, 2006

(54) ELECTRICAL CONNECTOR FOR MEMORY MODULES

(75) Inventors: Richard E Hamner, Hummelstown, PA (US); James P Scholz, Mechanicsburg, PA (US); Edmund L Jacobs, Harrisburg, PA (US); Attalee S Taylor, Palmyra, PA (US); Troy E Conner, York, PA (US); Ronald E Katzaman, Enola, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/996,727

(22) Filed: Nov. 24, 2004

(65) Prior Publication Data

US 2005/0112933 A1 May 26, 2005

Related U.S. Application Data

(60) Provisional application No. 60/525,628, filed on Nov. 26, 2003.

(51) Int. Cl.
*H01R 24/00* (2006.01)

(52) U.S. Cl. ..... 439/637; 439/943

(58) Field of Classification Search ..... 439/636–637, 439/751, 943

See application file for complete search history.

(56) References Cited

U.S. PATENT DOCUMENTS

| | | | | |
|---|---|---|---|---|
| 5,082,459 | A | 1/1992 | Billman et al. | |
| 5,580,257 | A | 12/1996 | Harwath | 439/108 |
| 6,071,152 | A * | 6/2000 | Achammer et al. | 439/733.1 |
| 6,102,744 | A | 8/2000 | Korsunsky et al. | |
| 6,616,459 | B1 * | 9/2003 | Norris | 439/751 |
| 6,672,886 | B1 * | 1/2004 | Billman | 439/82 |

* cited by examiner

*Primary Examiner*—Javaid H. Nasri

(57) ABSTRACT

A memory module electrical connector is comprised of an insulative housing and a plurality of electrical terminals. The terminals are stamped and formed from conductive material to include resilient contact portions for interconnection to the module, and compliant pin portions for interconnection to the printed circuit board. The compliant pin portions of the connector are laterally staggered, with some compliant pin portions being positioned adjacent to a slot in the housing for receiving the memory module, and alternate contacts are positioned distant from the slot, thereby staggering the compliant pin portions. The compliant pin sections include an upstanding, rigidifying section to rigidify the compliant pin portion during the insertion of the electrical connector and the plurality of compliant pin portions into the printed circuit board.

20 Claims, 17 Drawing Sheets

ELECTRICAL CONNECTOR FOR MEMORY MODULES

This application claims the benefit of U.S. Provisional Patent Application Ser. No. 60/525,628 filed Nov. 26, 2003, the complete disclosure of which is hereby expressly incorporated by reference.

FIELD OF THE INVENTION

The field of the invention relates to electrical connectors and particularly electrical connectors for interconnecting memory modules to printed circuit boards.

BACKGROUND OF THE INVENTION

Many different types of memory modules are provided for use in computer technology, such as DIMMs and SIMMs, which must be interconnected to a motherboard or other printed circuit board. Typically such connectors include a plastic housing having a plurality of electrical contacts mounted on one or both sides of a slot which receives the memory module, the connector further including electrical contacts which interconnect traces on the memory modules with traces on the printed circuit boards. Many different types of memory module connectors are provided, some of which include edge-stamped contacts, that is, where the entire contact is stamped or etched in a plane from a blank of conductive material, where the plane of the material is disposed transverse to the slot in the housing. Another type of electrical terminal is the stamped and formed terminal, where the terminal is also formed from a blank of material where the plane of the original material is parallel to the slot receiving the memory module, but the terminals are stamped and formed to form the various contact portions.

U.S. Pat. No. 5,082,459 shows a representative socket, where the contacts are edge-stamped and where the contacts include alternative printed circuit board receiving contact positions, such that alternate contacts can have staggered printed circuit board contact portions so as to increase the side-to-side density of the contacts as well as the position of the throughholes on the printed circuit board. As mentioned above, such edge-stamped contacts are stamped in a single plane of the material, where the edge which is stamped or etched is the contact surface.

Alternatively, another style of contact is shown in U.S. Pat. No. 6,102,744, where the contacts are stamped and formed, where the contacts include both a memory module contact and a printed circuit board contact. Some of the contacts are stamped and formed so as to lie substantially in a single plane, whereas other contacts are formed with a printed circuit board portion staggered laterally away from the slot so as to stagger the electrical terminals.

It is the latter design, that is, the design as substantially shown in U.S. Pat. No. 6,102,744, which is incorporated in its entirety herein, to which the present invention relates. As shown in U.S. Pat. No. 6,102,744, the printed circuit board tine portions are profiled for receipt in printed circuit board throughholes, and are adapted for a soldered connection to the throughhole. While this design has proven quite adequate for such soldered connections, in the case of a compliant pin portion, that is, where the printed circuit board contact portion includes a configuration for interferingly fitting within a plated throughhole of a printed circuit board, the contacts having the staggered printed circuit board contact can be damaged.

The damage does not occur in the contacts where the printed circuit board portion is in the same plane as the memory module contact, because the column strength of the memory module contact itself is sufficiently rigid to withstand the force of the insertion of the terminal into the throughhole. However, when the contacts are staggered, the compliant pin portion does not have sufficient rigidity in the plane of the compliant pin portion to allow a force on that portion of the terminal and yet be inserted without damage to the contact and/or connector.

It is this problem which the present invention addresses.

SUMMARY OF THE INVENTION

The objects of the invention have been accomplished by providing an electrical connector of the type for receiving a memory module, the connector comprising an electrical connector housing having a board mounting face and a module receiving face, the module receiving face including a slot for receiving a memory module, and contact receiving cavities flanking the slot. Electrical terminals are received in the cavities, each terminal including a memory module contact facing, and partially overlapping, the slot, and the terminals including compliant printed circuit board connecting portions. Some of the compliant portions are planar with its corresponding memory module contact, and some of the compliant printed circuit board connecting portions are staggered laterally away from the slot to stagger adjacent compliant printed circuit board connecting portions. The staggered compliant printed circuit board connecting portions are connected to the memory module contacts by way of a tail portion, and the electrical terminals include at least one rigidifying finger adjacent to the compliant pin portion, for rigidifying the compliant printed circuit board connecting portions during insertion of the connector into a printed circuit board.

The at least one rigidifying finger preferably upstands in the plane of the compliant printed circuit board connecting portions.

The at least one rigidifying finger, also preferably upstands beyond the intersection of the compliant printed circuit board connecting portions and the tail portions. The electrical terminals are stamped and formed from a metal material with the tail portions sheared from the material forming the compliant printed circuit board connecting portions, with the rigidifying fingers upstanding in the plane of the material forming the compliant printed circuit board connecting portions.

The electrical contacts may each include two rigidifying fingers, flanking the tail portion. Alternatively, the electrical contacts may each include a single rigidifying finger, with the tail portion flanking the single rigidifying finger.

The housing includes transverse cavity portions to receive the rigidifying fingers. The transverse cavity portions may be formed of a generally circular shaped cross-section, and the rigidifying fingers are generally rectangular in cross-section, wherein the rigidifying fingers are forced fitted in said transverse cavity portions, with corners of said rigidifying fingers interferingly fitting in said generally circular shaped cross-sectional cavity portions. The contact receiving cavities open onto the board-mounting face. The memory module contacts include a retention portion for retaining the contact in the associated contact-receiving cavity.

In an alternative embodiment of the invention, an electrical connector of the type for receiving a memory module comprises an electrical connector housing having a board mounting face and a module receiving face. The module receiving face includes a slot for receiving a memory module and contact receiving cavities flanking the slot. Electrical terminals are received in the cavities, each terminal including a memory module contact facing, and partially overlapping, the slot, and the terminals including compliant printed circuit board connecting portions, at least some of the compliant printed circuit board connecting portions being staggered laterally away from the slot to stagger adjacent compliant printed circuit board connecting portions, the staggered compliant printed circuit board connecting portions being connected to the memory module contacts by way of a tail portion, and the electrical terminals including at least one rigidifying finger adjacent to the compliant pin portion, for rigidifying the compliant printed circuit board connecting portions during insertion of the connector into a printed circuit board, the at least one rigidifying finger upstands in the plane of the compliant printed circuit board connecting portions.

The at least one rigidifying finger, preferably upstands beyond the intersection of the compliant printed circuit board connecting portions and the tail portions. The terminals are stamped and formed from a metal material with the tail portions sheared from the material forming the compliant printed circuit board connecting portions, with the rigidifying fingers upstanding in the plane of the material forming the compliant printed circuit board connecting portions.

The electrical contacts may each include two rigidifying fingers flanking the tail portion. Alternatively, the electrical contacts may each include a single rigidifying finger, with the tail portion flanking the single rigidifying finger.

The housing includes transverse cavity portions to receive the rigidifying fingers. The transverse cavity portions may be formed of a generally circular shaped cross-section, and the rigidifying fingers are generally rectangular in cross-section, wherein the rigidifying fingers are forced fitted in said transverse cavity portions, with corners of said rigidifying fingers interferingly fitting in said generally circular shaped cross-sectional cavity portions. The contact receiving cavities open onto the board-mounting face. The connector further comprises a channel that opens onto the mounting face, and which interconnects the contact receiving cavities and the transverse cavity portions, and receives the tail portions therein. The memory module contacts include a retention portion for retaining the contact in the associated contact-receiving cavity.

In an inventive method of forming an electrical terminal for the connector, the method includes the steps of providing a blank of suitably conductive material in a planar form; forming an edge contact on a portion thereof profiled for contact with a memory module; forming a compliant pin portion profiled for receipt within a throughhole of a printed circuit board; forming a substantially vertical shear line in the material forming the compliant pin portion; and bending the compliant pin portion relative to the shear line to form a tail portion interconnecting the compliant pin portion and the edge contact, with a rigidifying finger upstanding in the plane of the compliant pin portion, and beyond the intersection of the tail portion and compliant pin portion.

The electrical contacts are preferably formed into a substantially Z-shaped configuration. The electrical contacts may each be formed to include two rigidifying fingers flanking the tail portion. Alternatively, the electrical contacts may each be formed to include a single rigidifying finger, with the tail portion flanking the single rigidifying finger.

The method may also further comprise the step of forming an insulative housing, in which said electrical contacts are housed, including transverse cavities wherein said rigidifying fingers are positioned. The transverse cavity portions are formed of a generally circular shaped cross-section, and the rigidifying fingers are generally rectangular in cross-section, wherein the rigidifying fingers are forced fitted in said transverse cavity portions, with corners of said rigidifying fingers interferingly fitting in said generally circular shaped cross-sectional cavity portions.

In another embodiment of the invention, an electrical connector comprises an electrical connector housing having a board mounting face and an upper face, the housing including contact receiving cavities, where at least some of the contact receiving cavities have bearing surfaces adjacent the cavities, which are recessed from the board mounting face. Electrical terminals are received in the cavities, each terminal including a contact portion extending upwardly from an intermediate retaining portion and printed circuit board connecting portions extending downwardly from the intermediate retaining portion. The terminals further comprise engaging portions, adjacent the intermediate retaining portions, having a cross sectional area larger than the intermediate retaining portion. The engaging portions are profiled to contact the bearing surfaces of the housing.

The bearing surfaces may be defined by recessed surfaces flanking the cavities, and the engaging portions may be U-shaped.

DETAILED DESCRIPTION OF THE DRAWINGS

Figure 1:
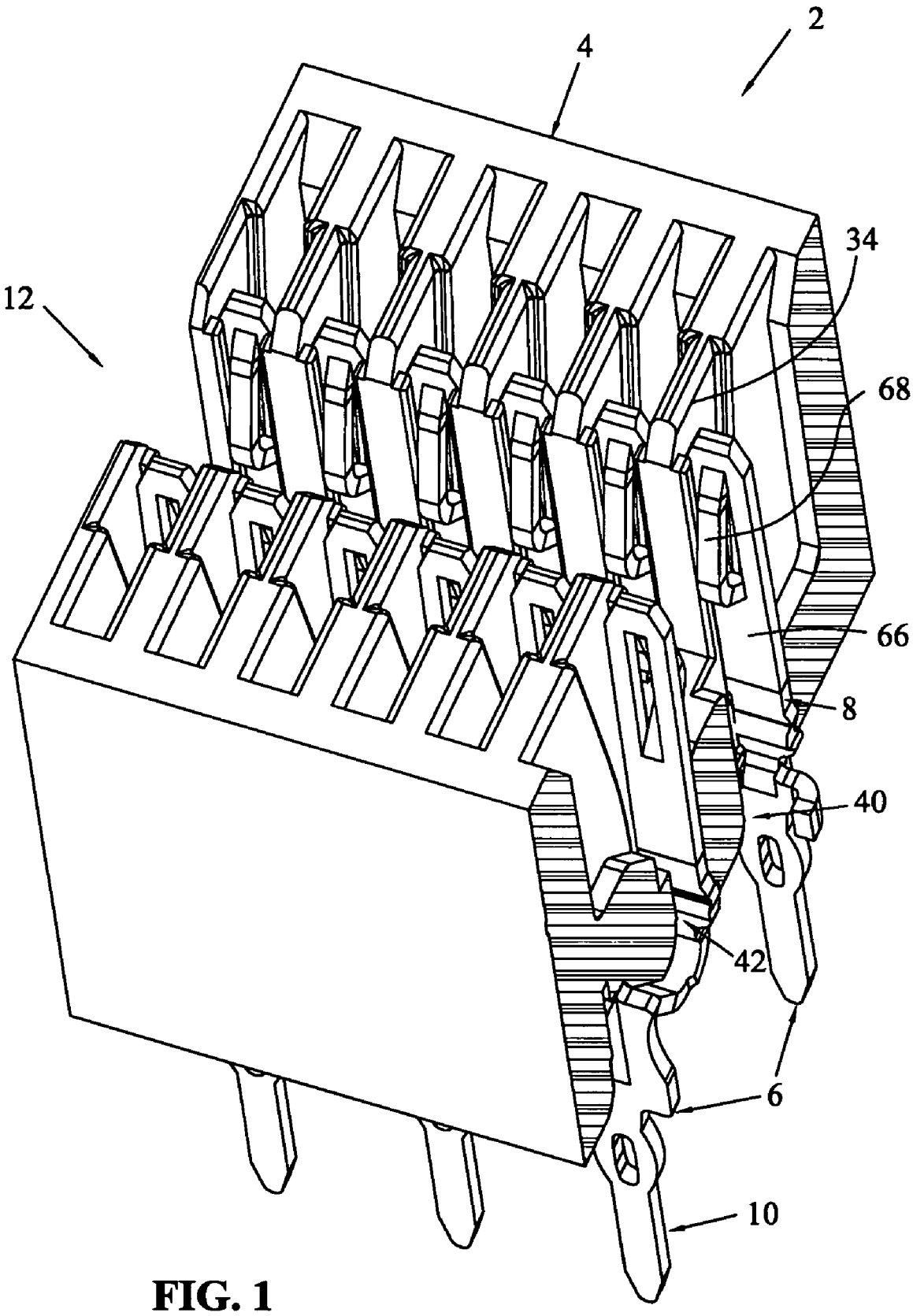
FIG. 1 is a perspective view of a memory module of the present invention partially cut away at one end to show the internal construction.

With reference first to FIG. 1, an electrical connector is shown generally at 2, as a memory module connector, and includes an insulative housing at 4 and a plurality of electrical contacts, shown generally as an array 6. The array 6 includes contacts 8, where the compliant pin portion is substantially in the same plane as the memory module contact, and contacts 10, where the compliant pin portion is staggered relative to a memory module contact. As also shown in FIG. 1, the housing 4 and contact array 6 generally form a receiving slot 12 for receipt of a memory module therein and for electrical connection therewith.

Figure 2:
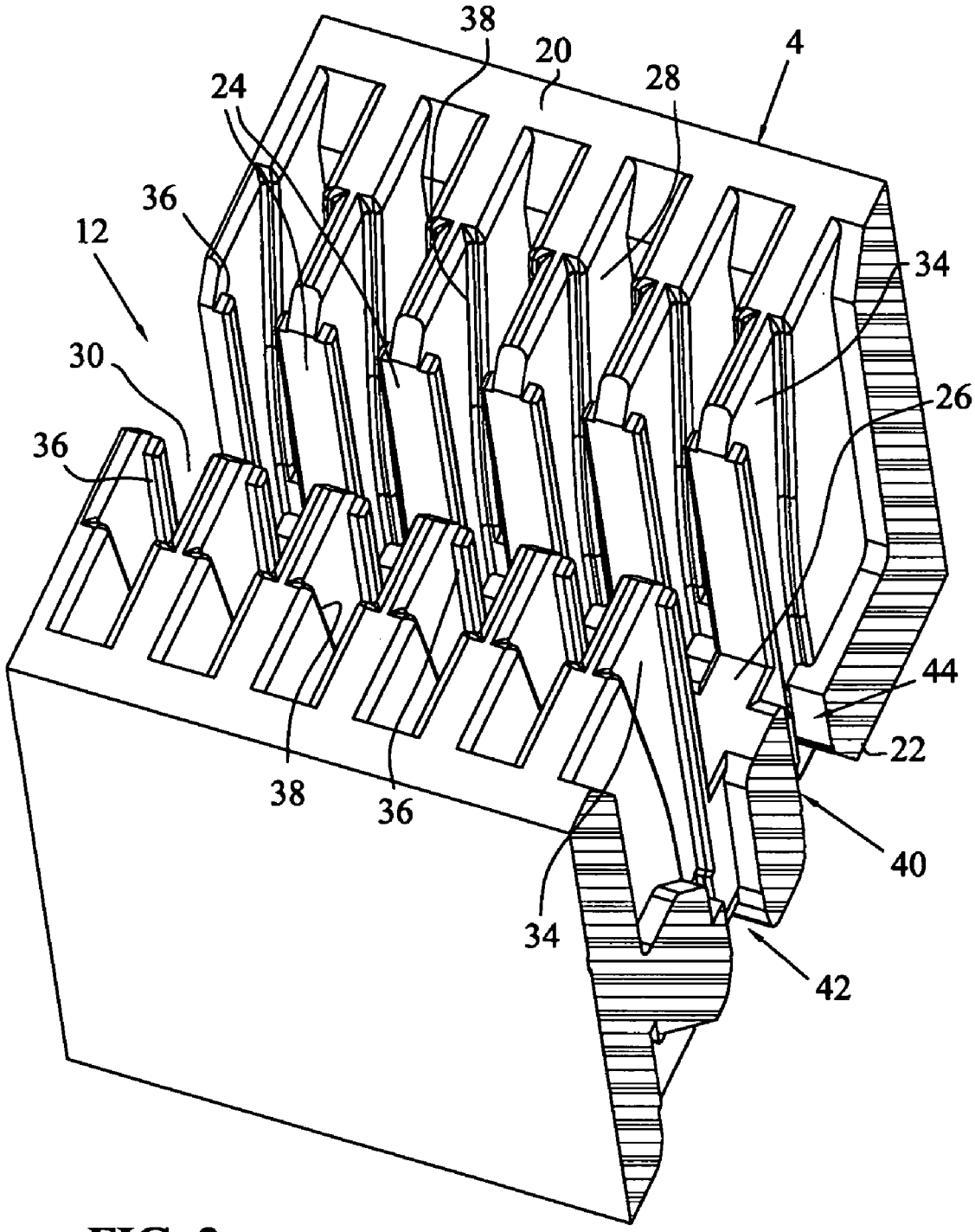
FIG. 2 is a view similar to that of FIG. 1 less the terminals.
Figure 3:
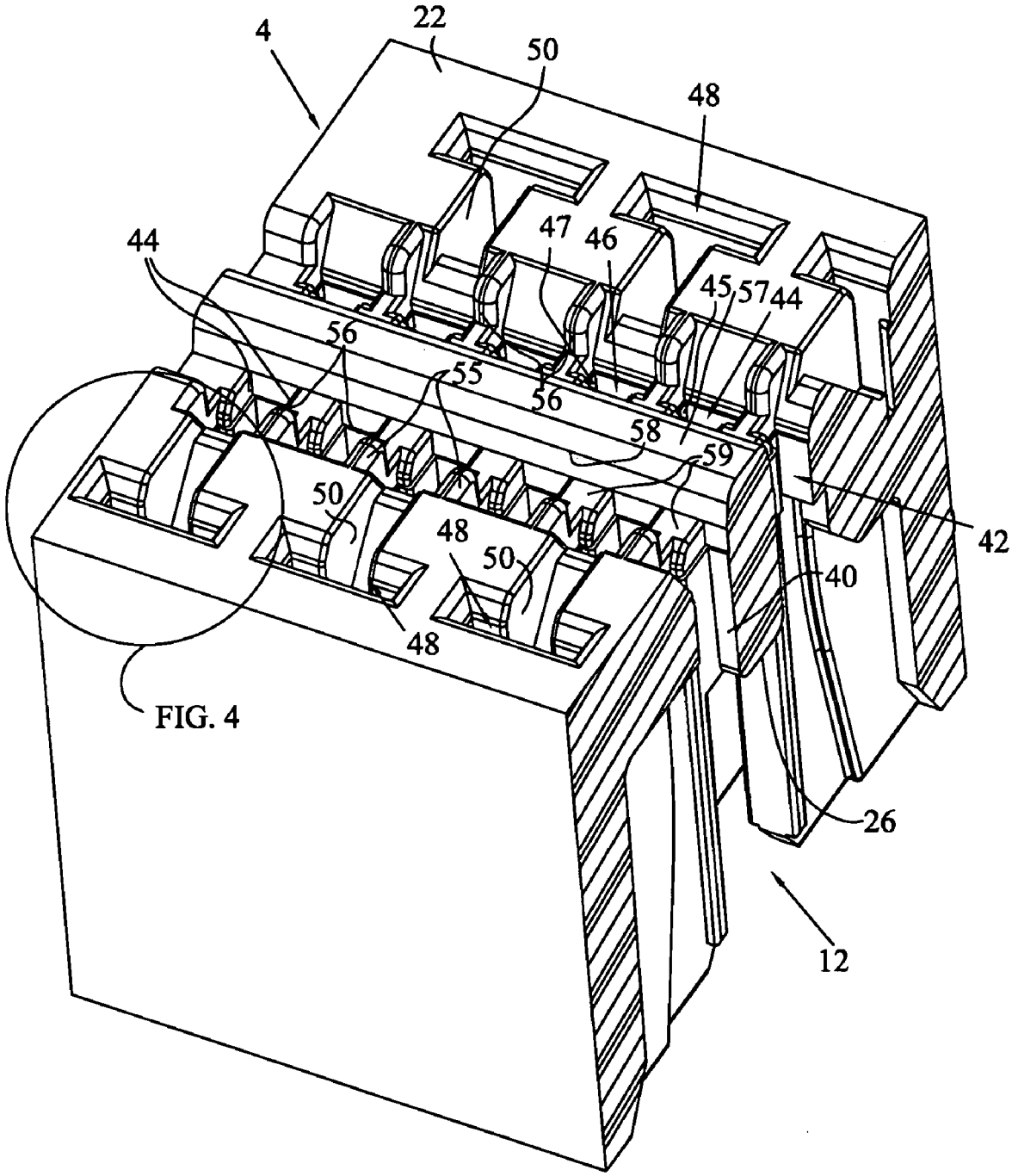
FIG. 3 is an underside perspective view of the housing of FIG. 2.
Figure 4:
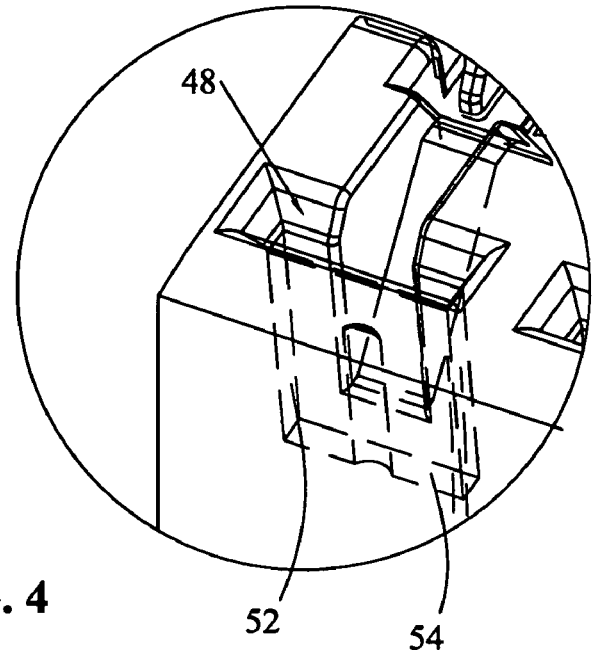
FIG. 4 is an enlarged view of the are designated in FIG. 3.

With reference now to FIGS. 2–4, housing 4 will be described in greater detail. As shown in FIG. 2, housing 4 includes a module receiving face 20 and mounting face 22, and slot 12 is formed by side wall facing portions 24 and a lower wall portion 26. The housing 4 also includes upper slots 28, which includes a slotted opening at 30 and recessed relief areas at 34, which defines rearwardly facing shoulders 36 and forwardly facing shoulders 38. As also shown in FIGS. 2 and 3, housing 4 includes two different openings, 40 and 42, for receiving different electrical terminals. Opening 40 simply extends straight through between lower wall portion 26 and mounting face 22 and includes a T-shaped opening 44 having side walls 45, as will be described further herein.

With reference to FIGS. 3 and 4, openings 42 also extend between the mounting face 22 and lower wall portion 26. Openings 42 also include a T-shaped opening 46 having side walls 47. However, each includes a transverse cavity 48 interconnecting each opening 42 by way of a channel at 50. As shown best in FIG. 4, transverse cavity 48 includes a rectangular-shaped opening defined by side edges 52 and lower surface 54. Finally, and as shown best in FIG. 3, housing 4 has ribs 55 flanking the openings 40, 42 having edges 56 facing a centerline of the housing. The housing also has a central rib 57 having a face 58, and bearing surfaces 59 flanking cavities 40, 42.

Figure 5:
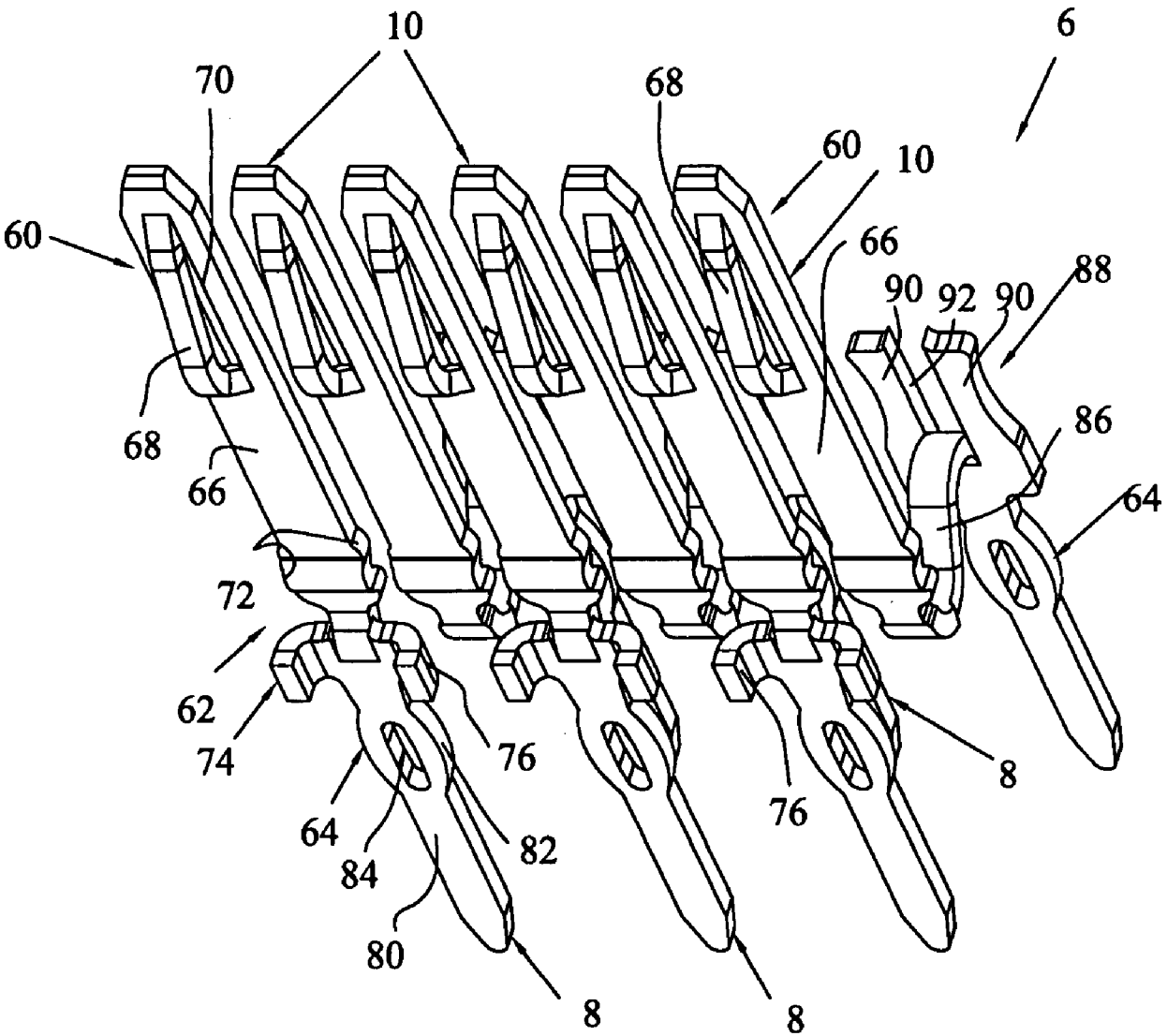
FIG. 5 shows a perspective view of the layout of one row of the electrical terminals for receipt within the housing of FIG. 2.

With respect now to FIG. 5, the contacts of the present invention are shown as the array 6 including a plurality of contacts 8 and a plurality of contacts 10, as described above. As shown, contacts 8 are generally comprised of a module contact portion 60, a retaining portion 62 and a compliant pin portion 64. With respect still to FIG. 5, the contact portion 60 is defined by an upstanding blade portion 66 having a protruding contact section 68 extending forwardly, as is known in the art, and thereby forming a stamped opening 70. The retaining portion 62 is defined by a plurality of engaging sections 72 on both sides of the blade portion 66 together with a U-shaped supporting portion 74 having arm portions 76.

Finally, the compliant pin portion 64 includes an extending tine portion 80, including a bulbous contact section 82 having a slot 84 therein. This type of compliant pin section is typically referred to as an "eye-of-the-needle"-type compliant pin section. However, it should be appreciated that other compliant pin portions, such as assignee's "ACTION PIN"-type contact or a split-arrow-type compliant section, would also be usable.

Figure 6:
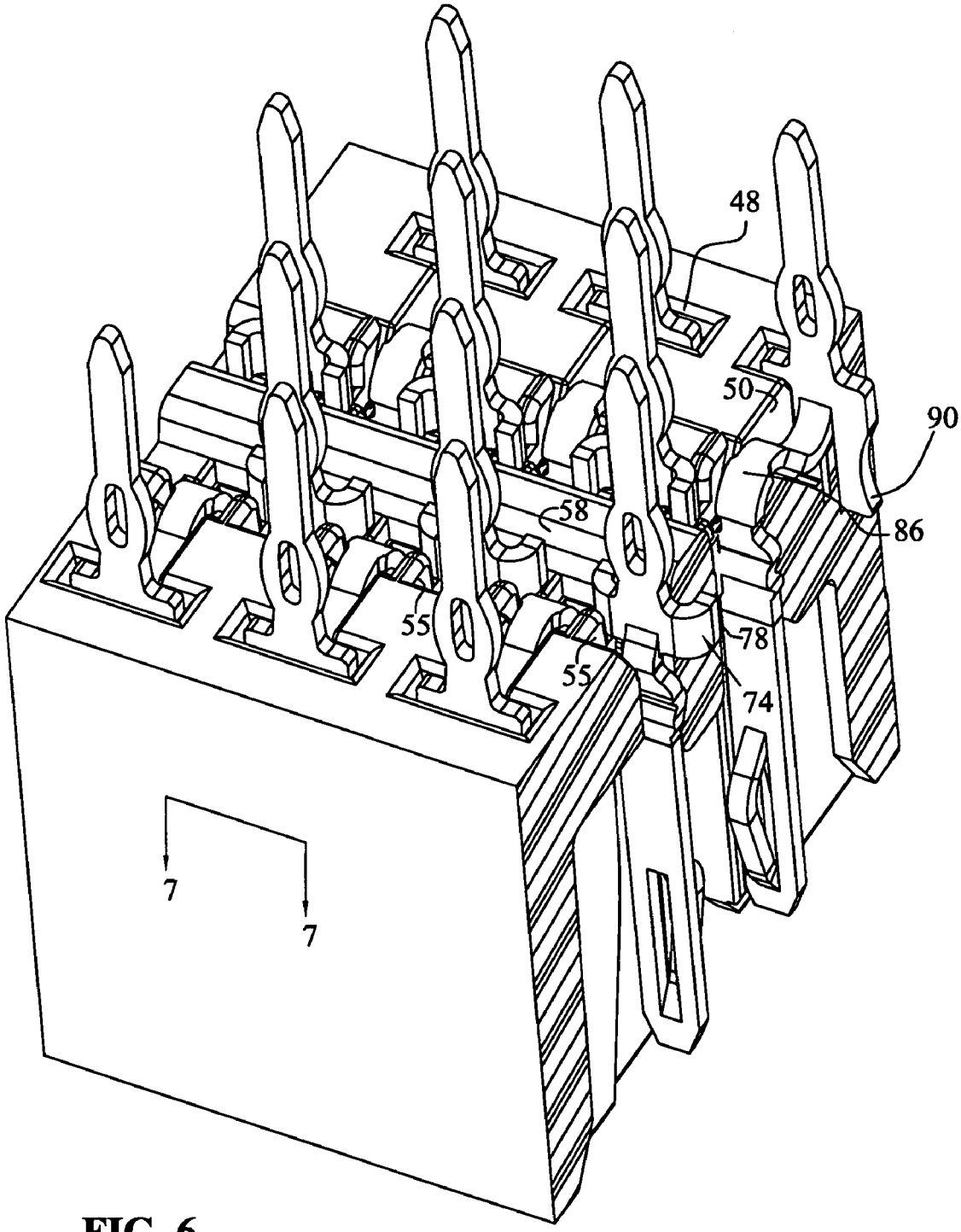
FIG. 6 is a perspective view showing the underside of the connector of FIG. 1 in the completed assembly.

With respect still to FIG. 5, terminals 10 include a similar module contact 60 and compliant pin portion 64, as is shown in contacts 8. However, terminals 10 stagger the blade portions 66 relative to the compliant pin portions 64 by way of an integral tail section 86, which forms the contact into a substantial Z-shaped configuration. To rigidify the compliant pin portion 64, contacts 10 also include a rigidifying section shown generally as 88, which is comprised of finger portions 90, which upstand in the same plane as the compliant pin portion 64 and flank the tail section 86. Tail section 86 is formed from the same material which forms the compliant pin portion 64 and is defined by providing shear lines at 92, which allows fingers 90 to upstand higher than the intersection of the tail section 86 with the compliant pin portion 64. With reference now to FIGS. 1 and 6, the assembly of the housing will now be described in greater detail.

Figure 7:
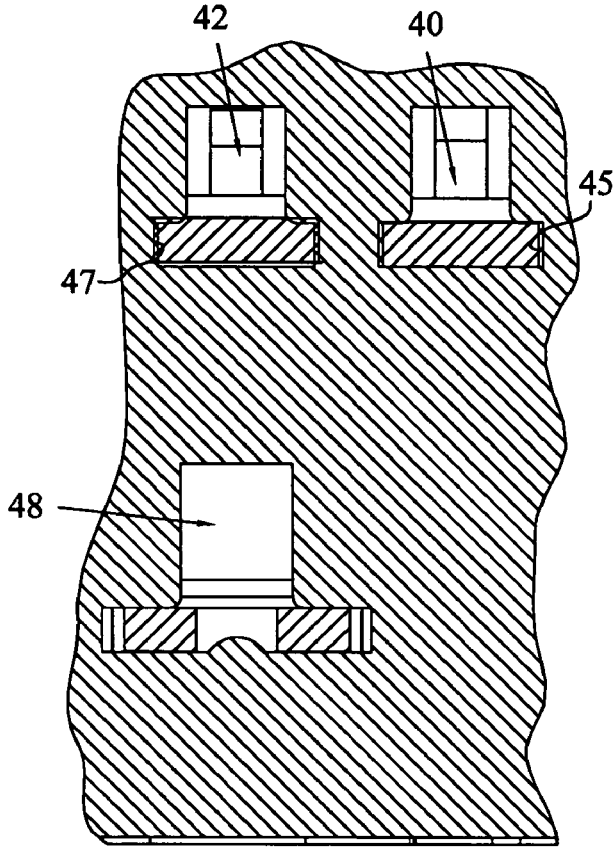
FIG. 7 is a cross-sectional view through lines 7—7 of FIG. 6.

As shown in FIGS. 1, 6 and 7, each of the contacts 8 are inserted in their representative openings 40, such that the engaging sections 72 (FIG. 5) interferingly fit side walls 45 (FIG. 3) of opening 40. As best shown in FIGS. 3 and 6, this also positions the U-shaped portions 74 (FIG. 3) in position on top of surfaces 59, and as further described herein. As shown in FIG. 1, this positions the blade portion 66 within relief area 34 and with contact section 68 extending through slotted opening 30 (FIG. 2).

As also shown in FIGS. 1 and 6, terminals 10 are inserted in their respective openings 42 and with each tail section 86 (FIG. 3) positioned in a respective channel 50. This positions upstanding rigidifying fingers 90 within their respective transverse cavities 48. This also positions engaging section 72 of terminals 10 in an interferingly fit relation with side walls 47, as best shown in FIG. 7.

Figure 8:
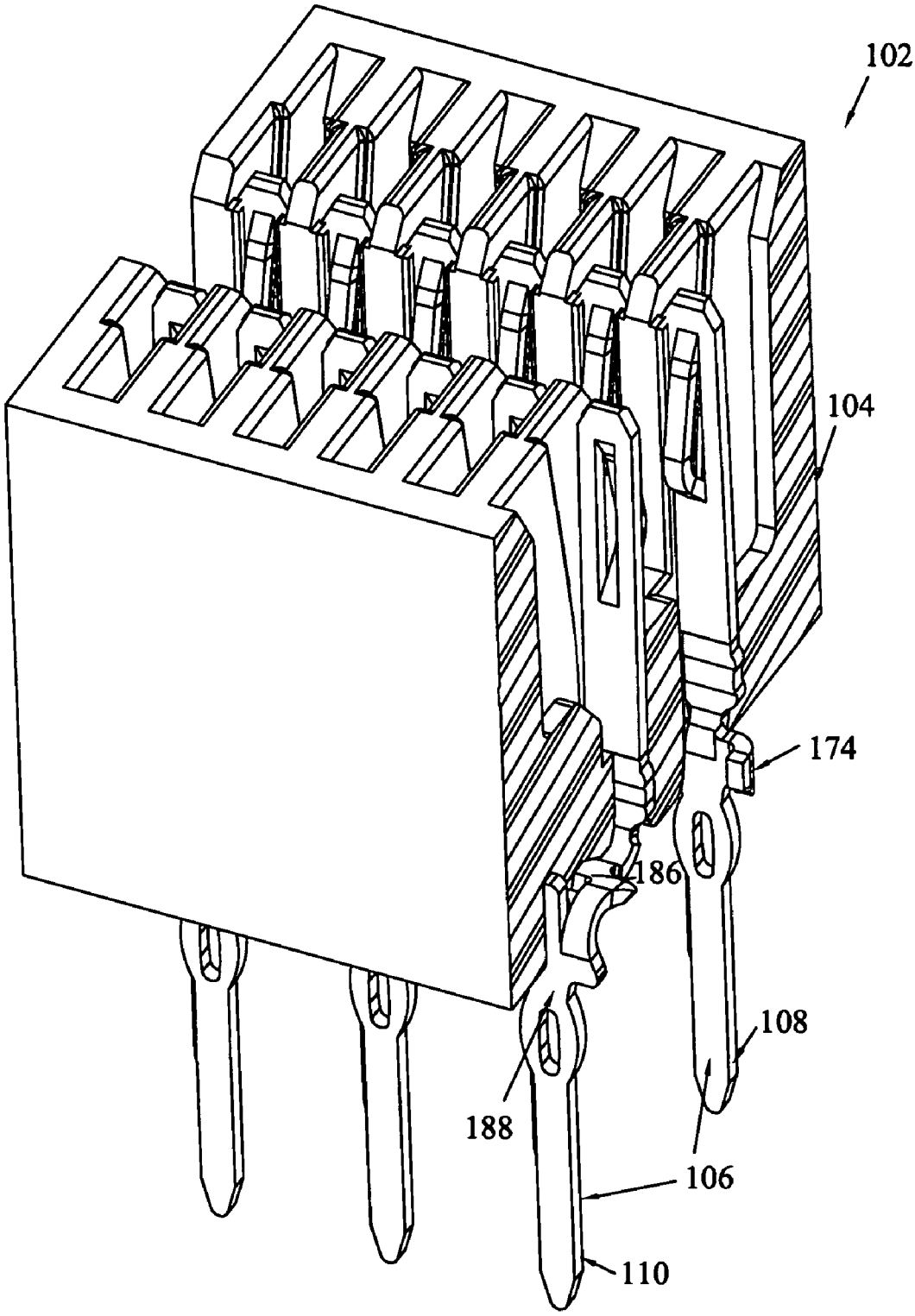
FIG. 8 shows an alternate embodiment of the connector of FIG. 1 with an alternate electrical terminal.
Figure 11:
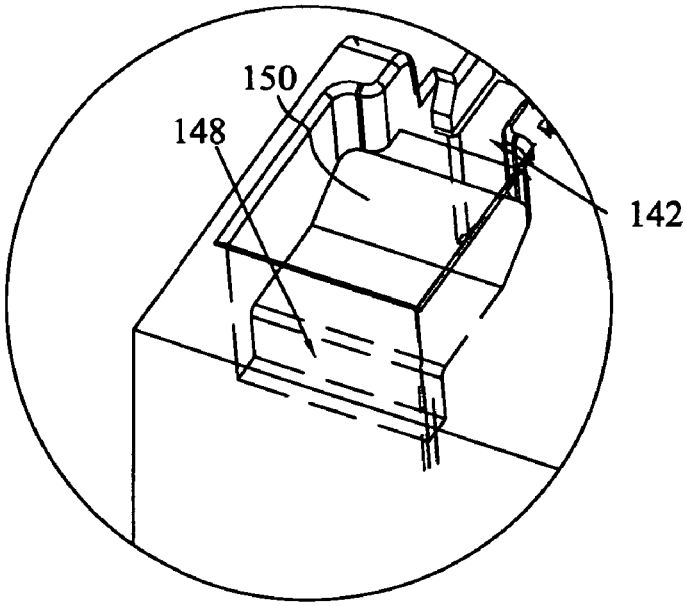
FIG. 11 is an enlarged view of the area designated in FIG. 11.
Figure 12:
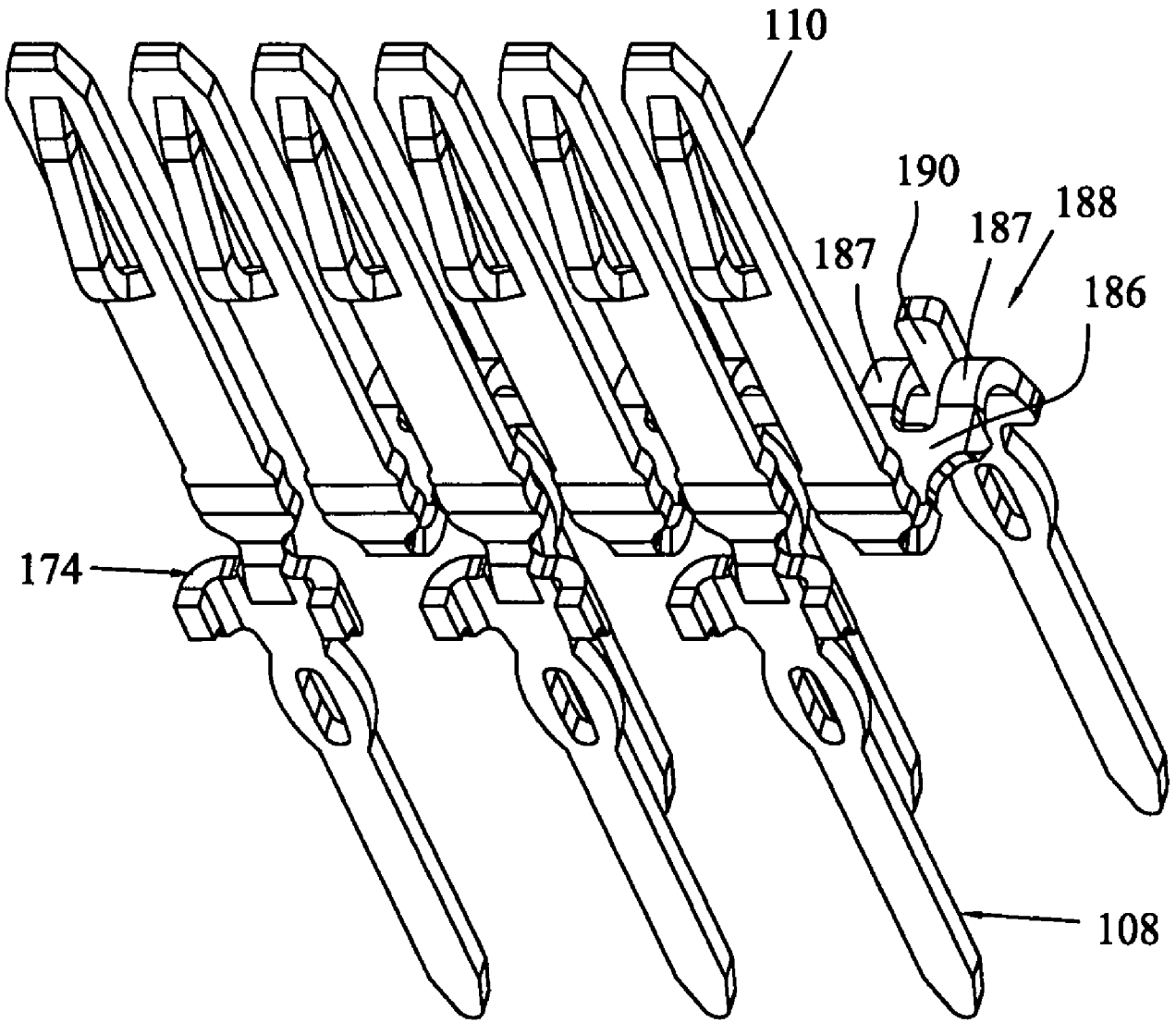
FIG. 12 shows a perspective view of the terminals for receipt within the housing of FIG. 6.
Figure 13:
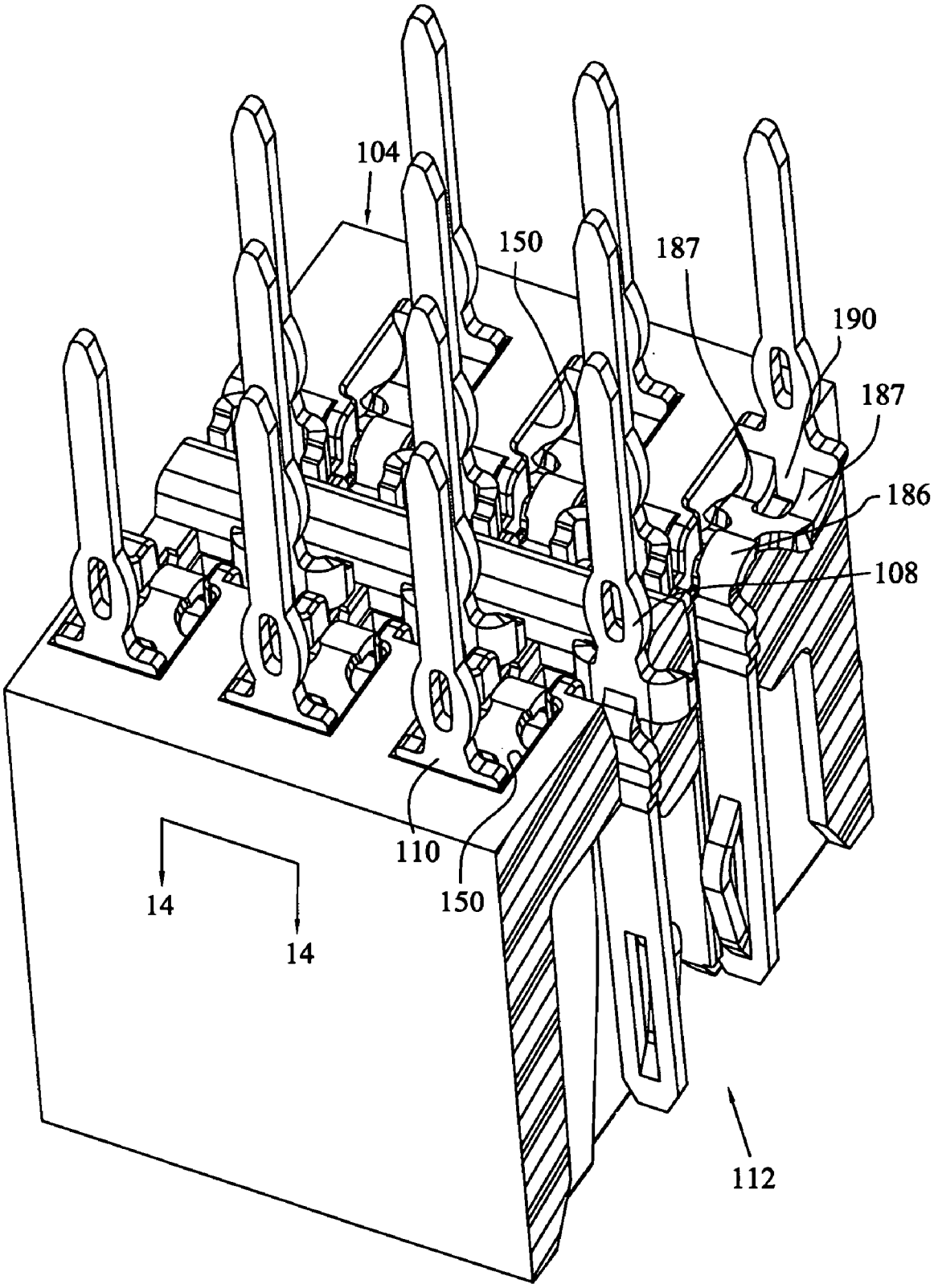
FIG. 13 shows a perspective view of the assembled connector from the bottom side with the terminals received in their respective passageways.
Figure 15:
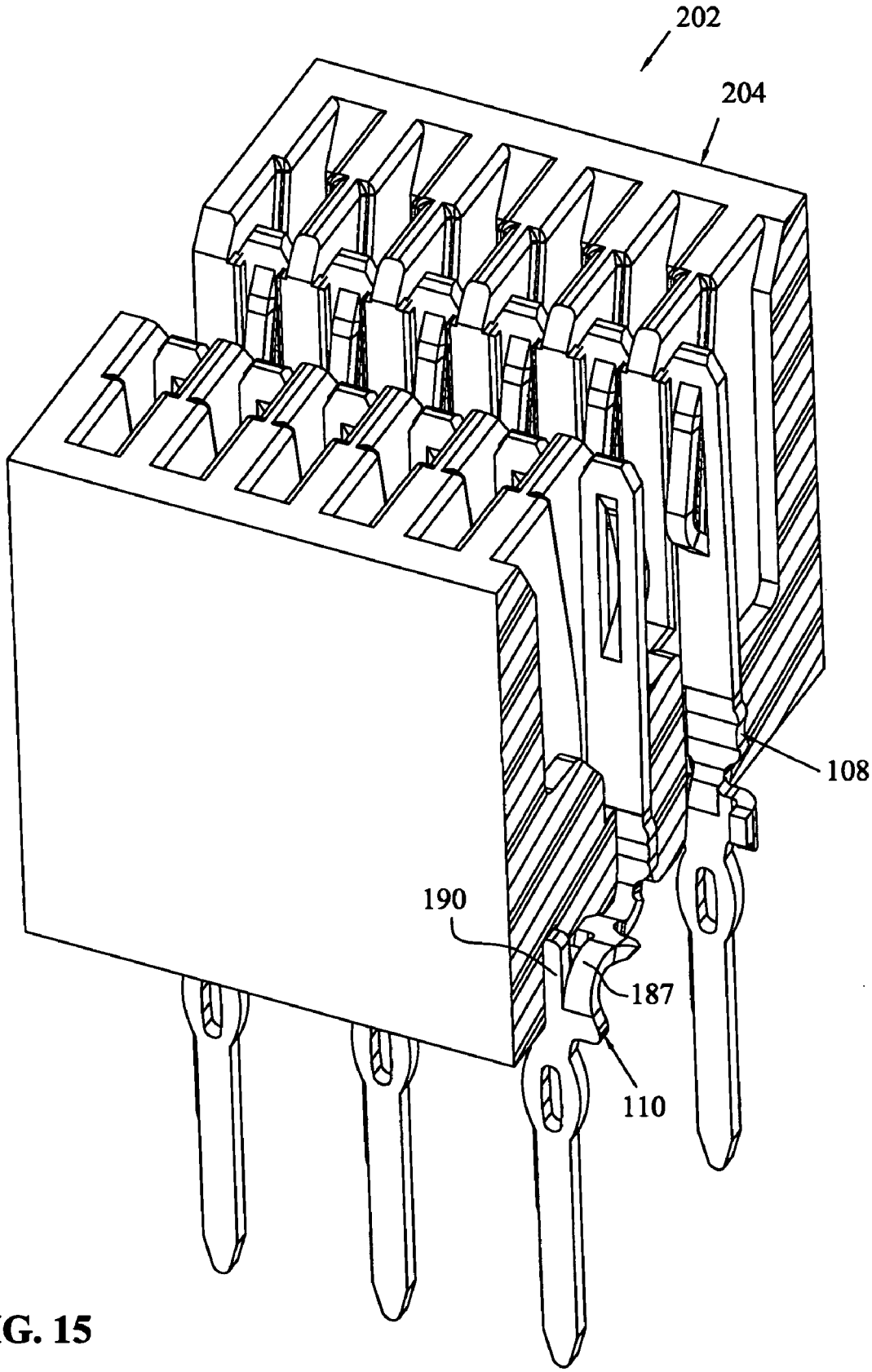
FIG. 15 shows a perspective view of yet another alternative embodiment.
Figure 16:
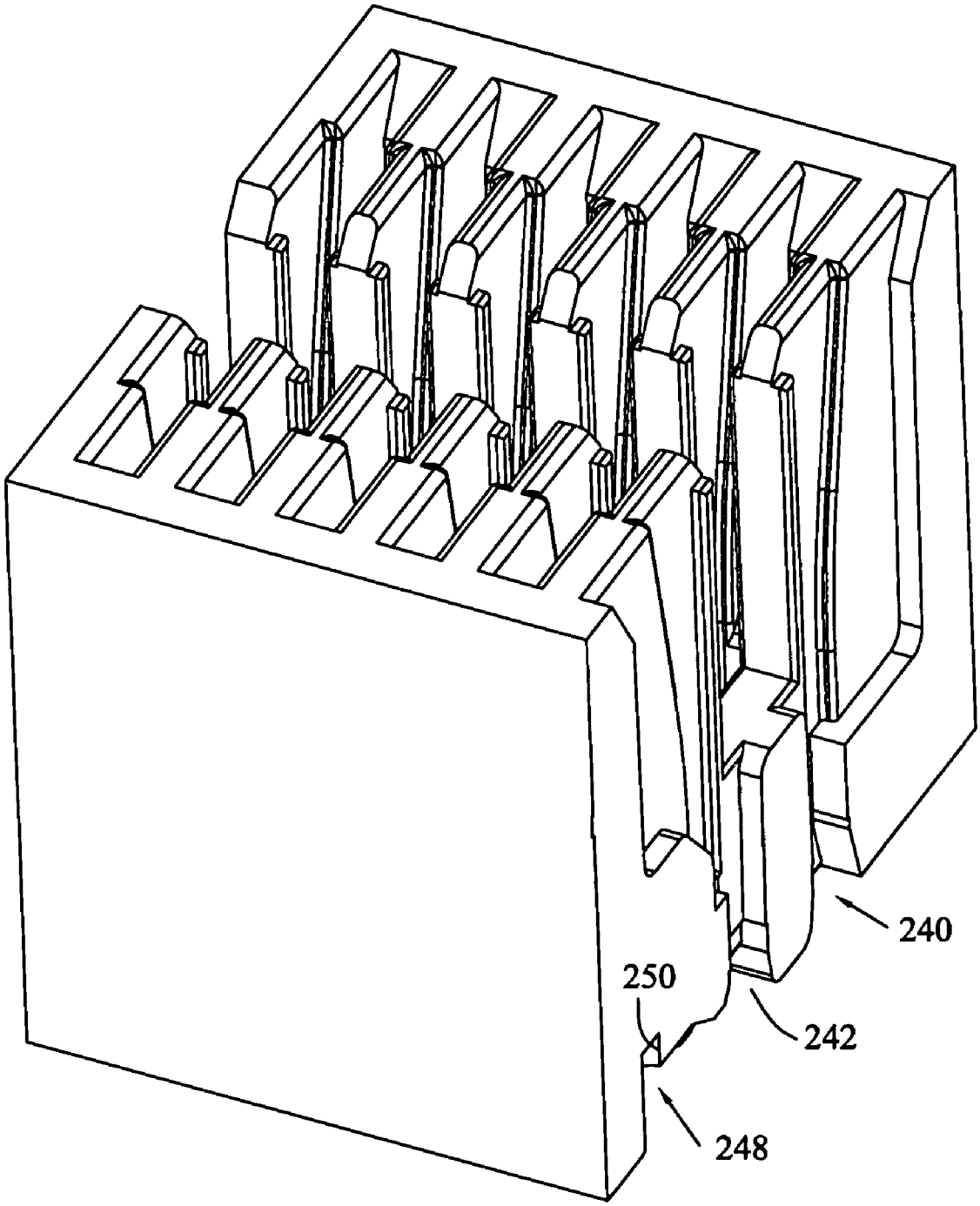
FIG. 16 shows an upper perspective view of the housing of FIG. 15.
Figure 17:
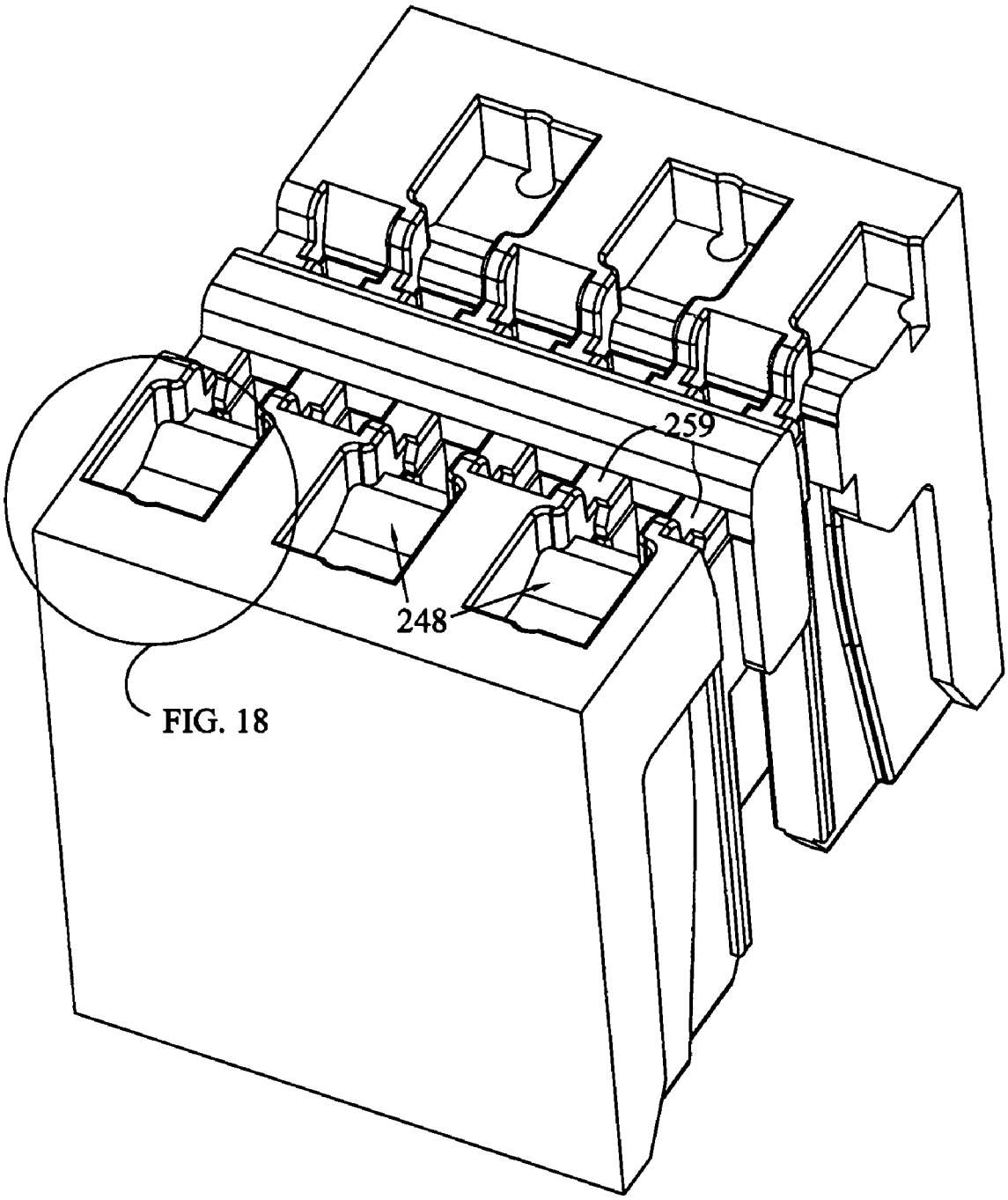
FIG. 17 shows a lower perspective view of the housing of FIG. 16.

With respect now to FIGS. 8, 12 and 13, another embodiment of the connector is shown at 102 having a housing 104 and an array of terminals 106, including terminals 108 and 110. This embodiment is substantially similar to that of FIGS. 1 through 7 and therefore only distinctions will be made with reference to FIGS. 8 through 13.

Figure 9:
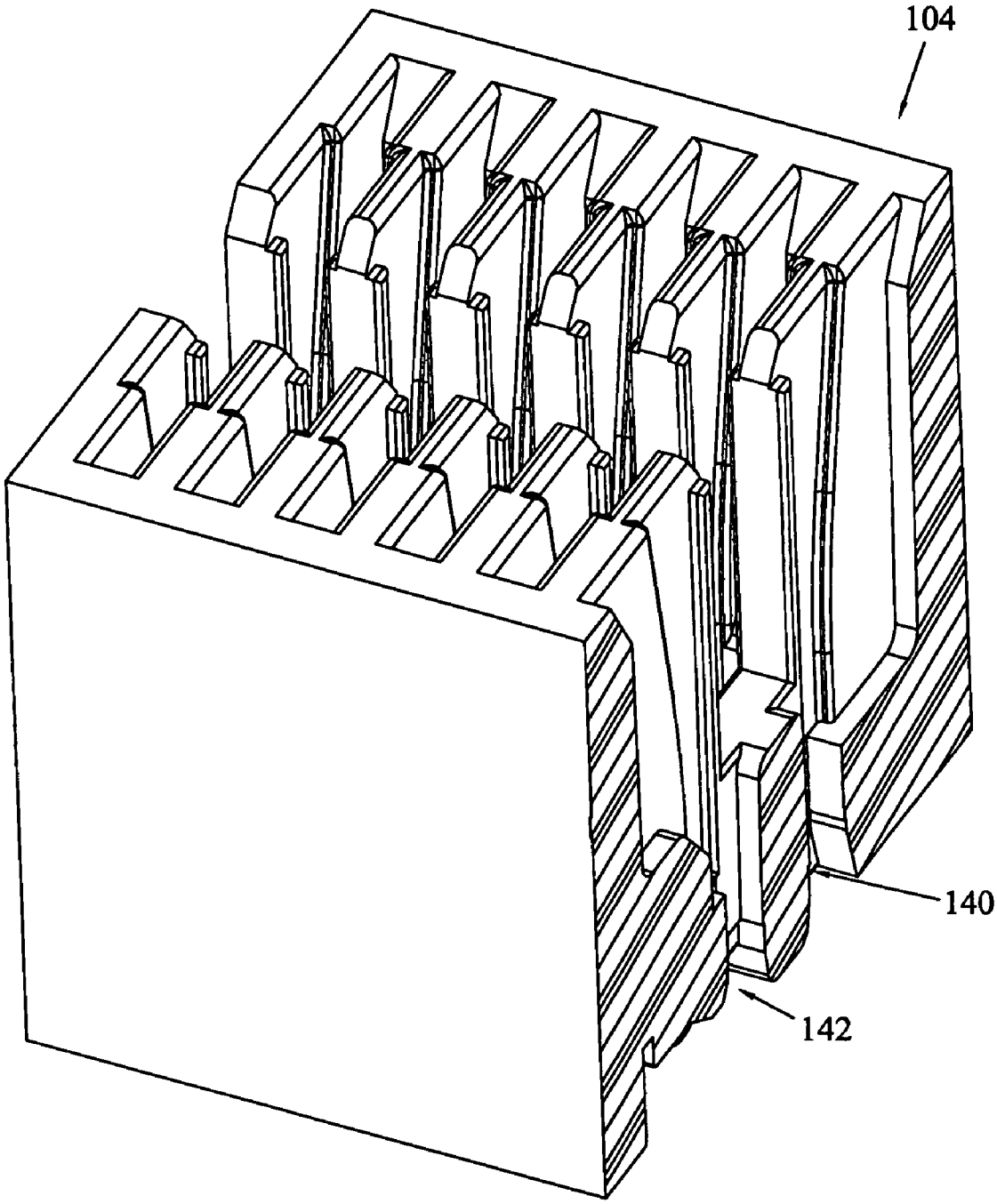
FIG. 9 is a view similar to that of FIG. 8, less the terminals.
Figure 10:
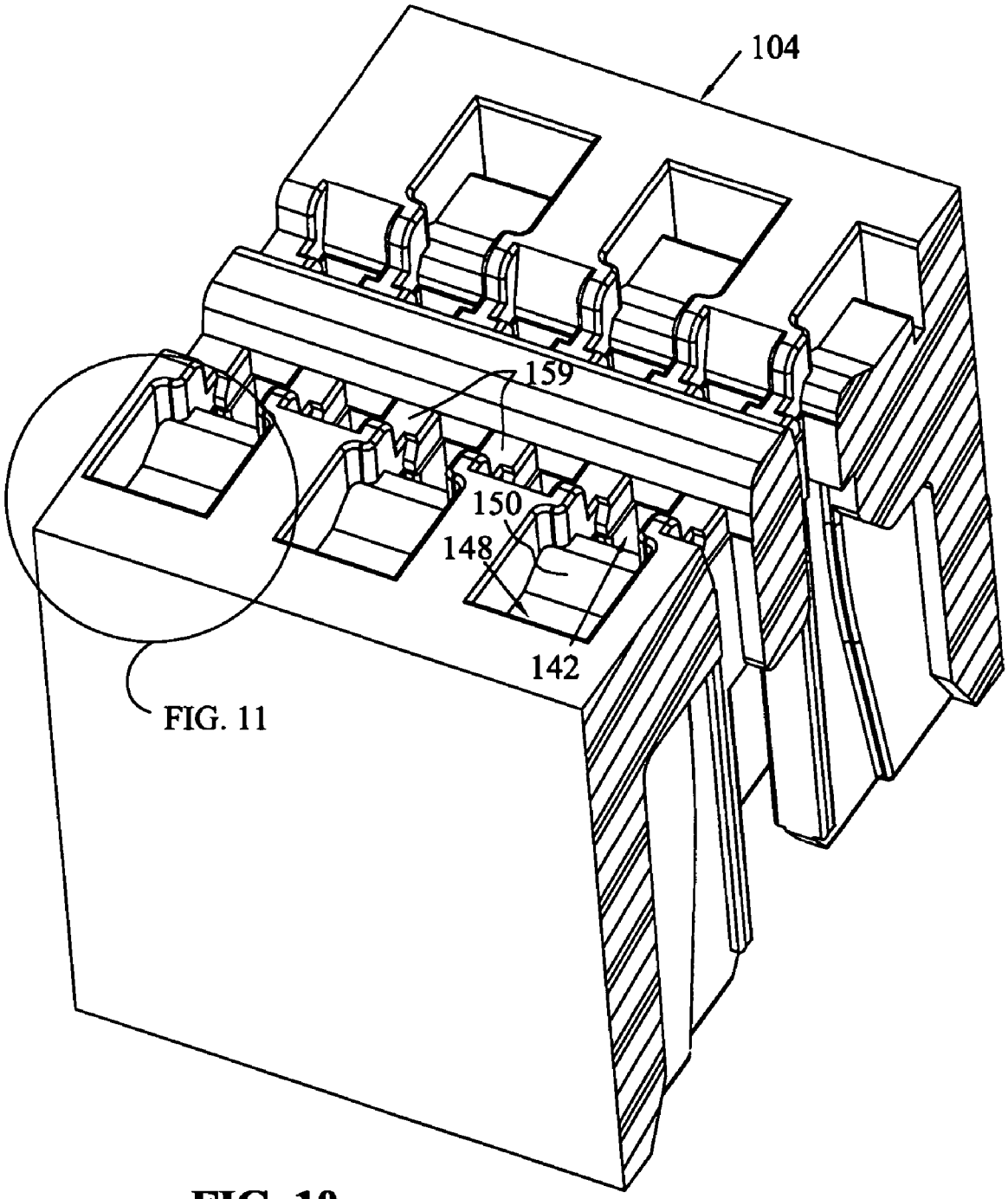
FIG. 10 is a lower perspective view of the housing of FIG. 9.
Figure 14:
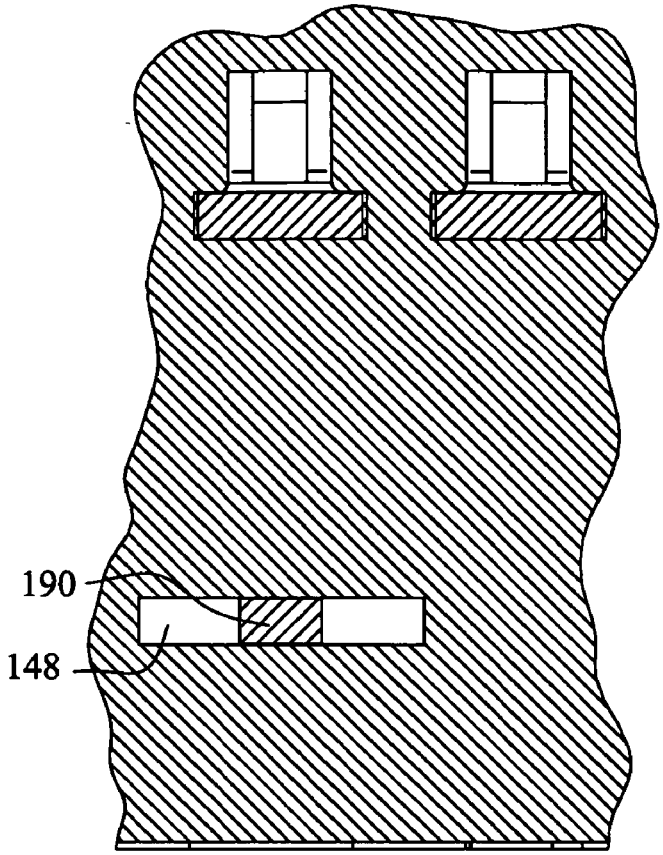
FIG. 14 shows a cross-sectional view through lines 14—14 of FIG. 13.

As shown best in FIGS. 8, 12 and 13, terminal 110 includes a rigidifying section 188 comprised of a single rigidifying finger 190 flanked by connecting portions 187 of tail portion 186, as opposed to the two rigidifying sections 90 of the prior embodiment, as shown in FIG. 3. With reference now to FIGS. 9–11, housing 104 is modified such that cavity 142 is interconnected to transverse cavity 148 by way of enlarged channel 150. As shown in FIGS. 8, 13 and 14, terminals 110 are shown positioned in cavities 142 with connecting portions 187 positioned in channel 150 and with portion 190 positioned in transverse cavity 148. Contacts 110 also flank the receiving slot 112 as shown in FIG. 8.

Figure 20:
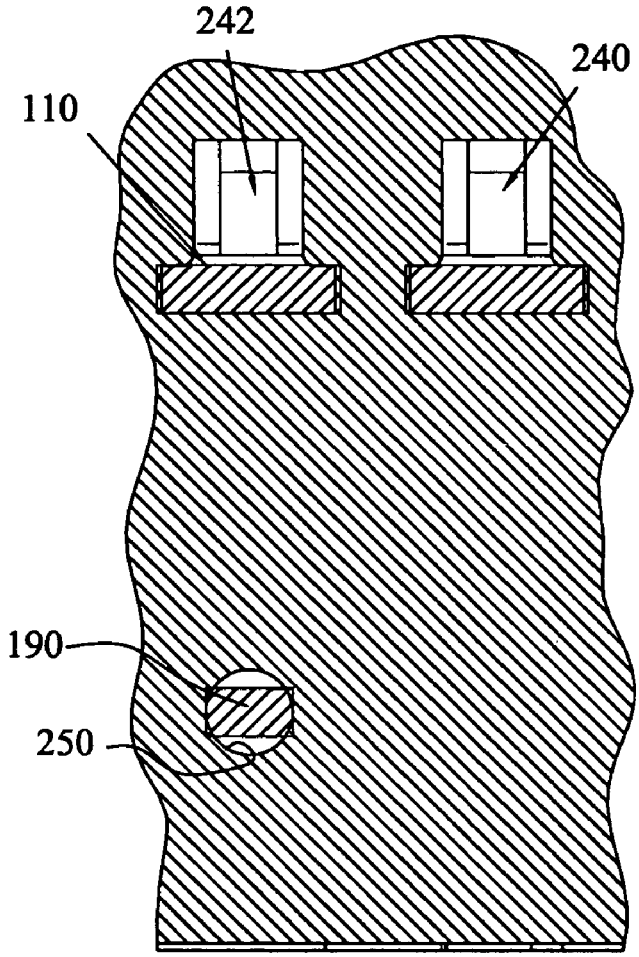
FIG. 20 shows a cross-sectional view through lines 20—20 of FIG. 19.
Figure 18:
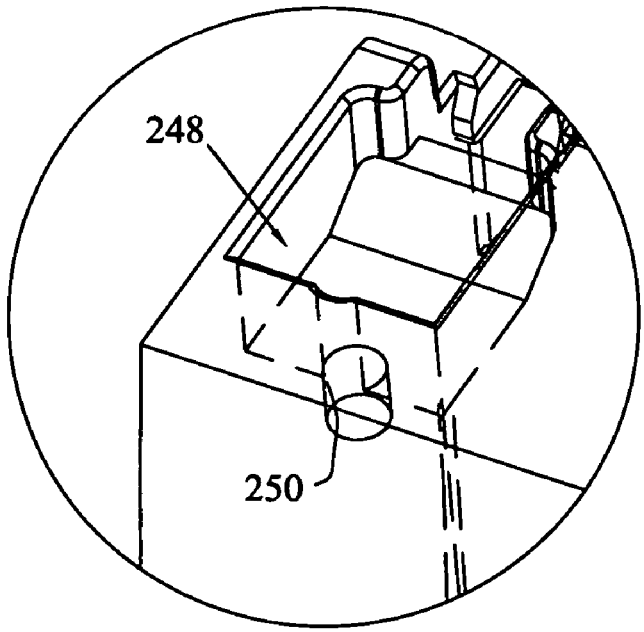
FIG. 18 is an enlarged view of the area designated in FIG. 17.
Figure 19:
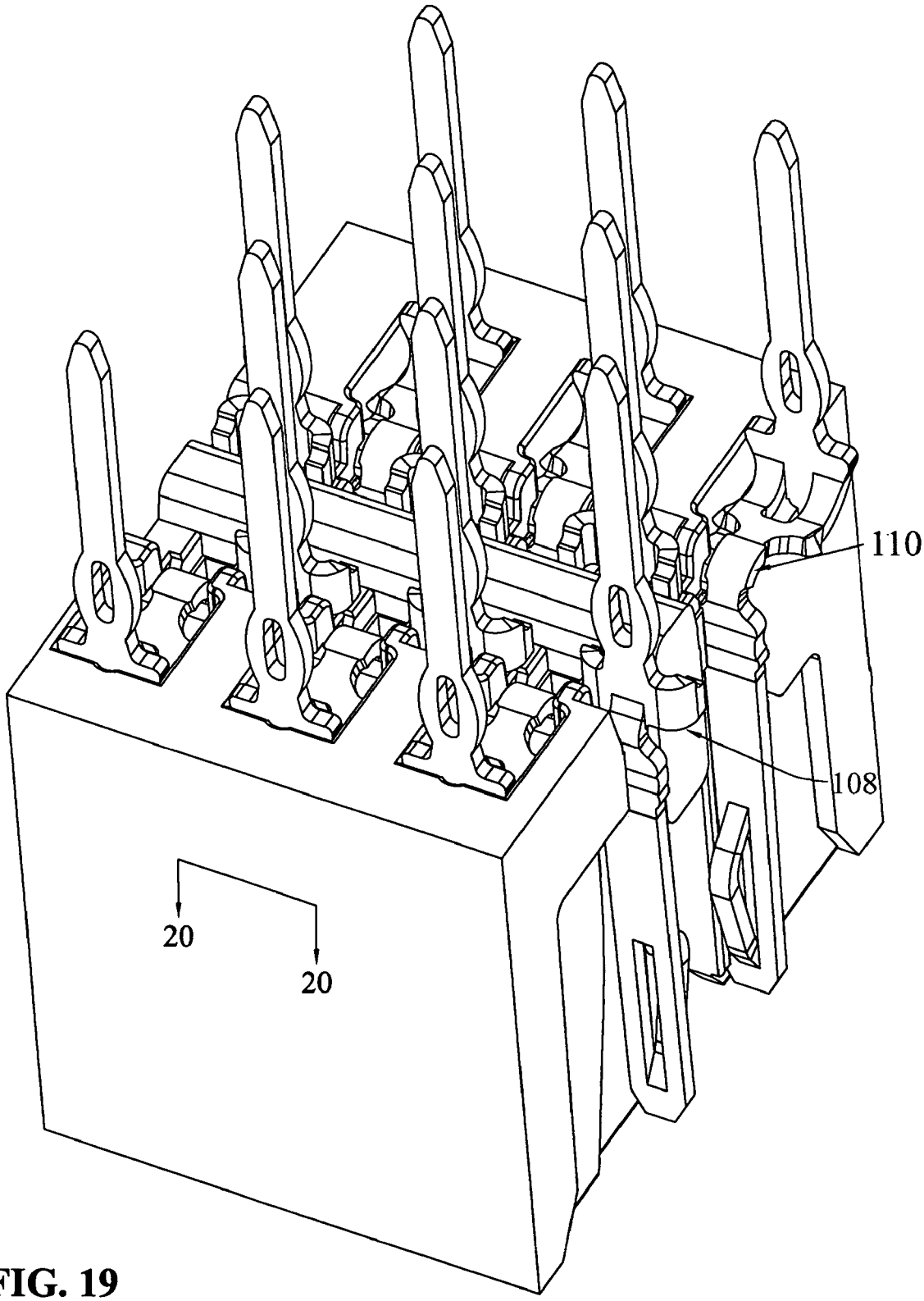
FIG. 19 shows a perspective view of the assembled connector of FIG. 15 from the bottom side with the terminals received in their respective passageways.

With reference now to FIGS. 15–20, another embodiment is depicted, which is a variation to that shown in FIGS. 5–8. This embodiment utilizes the same contacts 108 and 110, with a modified housing 204. Housing 204 has openings 240 and 242, and is modified with transverse cavities 248 including a transitional area 250 (FIG. 18) which is substantially circular in cross-section, where the diameter of area 250 is substantially equal to the width of finger 150. As shown in FIG. 20, the contact 110 and the corresponding transverse cavity 248 is shown in cross-section, taken through the transitional area 250. As shown, as the finger portion 190 is substantially rectangular, and as the transitional area is substantially circular, the four corners of finger 190 are shown interferingly fit within area 250.

Advantageously, and with reference again to FIGS. 5 and 12, the rigidifying sections 88, 188 rigidify the compliant pin sections to add column strength during insertion of the connector to the printed circuit board. As mentioned above, such connectors are inserted on printed circuit boards and the compliant pins require an exertion of force on the connector in order to insert the individual compliant pin portions into their respective throughholes. Thus, as the rigidifying portions 88, 188 lie substantially in the same plane as the compliant pin portions, the column strength of the compliant pin portions is rigidified in the vertical direction for insertion.

In addition, any of the connector housings 4, 104, 204 act as a seating tool for the respective compliant pin portions of the respective contacts 8, 10; 108, 110. That is, the transverse cavities 48, 148, 248 assist in applying a force on the rigidifying portions 88, 188 to assist the terminal to seat in a respective board if not seated. Also the U-shaped portions 74, 174 can be pushed by respective surfaces 59 (FIG. 3), 159 (FIG. 10), 259 (FIG. 17) of respective housings 4, 104, 204. In addition, because of the U-shaped portions, the surface area through which the force is applied (i.e., the pressure) between the U-shaped portions 88, 188, and their counterpart surfaces 59, 159, 259, is kept to a minimum. Finally, the rigidifying portions support the contacts in order for the contacts to maintain their true position and to be aligned with respective throughholes in a printed circuit board.

What is claimed is:

1. An electrical connector of the type for receiving a memory module, the connector comprising:

an electrical connector housing having a board mounting face and a module receiving face, the module receiving face including a slot for receiving a memory module, and contact receiving cavities flanking said slot, at least some of said contact receiving cavities comprising a transverse cavity having a downwardly directed surface;

electrical terminals for receipt in said cavities, each said terminal including a memory module contact facing, and partially overlapping, said slot, and said terminals including compliant printed circuit board connecting portions, some of said compliant portions being planar with its corresponding memory module contact, and some of said compliant printed circuit board connecting portions being staggered laterally away from said slot to stagger adjacent compliant printed circuit board connecting portions, the staggered compliant printed circuit board connecting portions being connected to said memory module contacts by way of a tail portion, and said electrical terminals including at least one rigidifying finger adjacent to said compliant pin portion, and positioned in respective transverse cavities, with a portion of said rigidifying finger positioned adjacent to said downwardly directed surface and with the entire length of said rigidifying finger positioned within said transverse cavities, for rigidifying said compliant printed circuit board connecting portions during insertion of said connector into a printed circuit board.

2. The electrical connector of claim 1, wherein said at least one rigidifying finger upstands in the plane of said compliant printed circuit board connecting portions.

3. The connector of claim 2, wherein the electrical contacts each include two rigidifying fingers, flanking the tail portion.

4. The connector of claim 2, wherein the electrical contacts each include a single rigidifying finger, with the tail portion flanking the single rigidifying finger.

5. The electrical connector of claim 1, wherein said at least one rigidifying finger, upstands beyond the intersection of said compliant printed circuit board connecting portions and said tail portions.

6. The electrical connector of claim 5, wherein the elecirical terminals are stamped and formed from a metal material with the tail portions sheared from the material forming said compliant printed circuit board connecting portions, with the rigidifying fingers upstanding in the plane of the material forming said compliant printed circuit board connecting portions.

7. The connector of claim 5, wherein the electrical contacts each include two rigidifying fingers, flanking the tail portion.

8. The connector of claim 5, wherein the electrical contacts each include a single rigidifying finger, with the tail portion flanking the single rigidifying finger.

9. The connector of claim 1, wherein said housing includes transverse cavity portions to receive said rigidifying fingers.

10. The connector of claim 9, wherein said transverse cavity portions are of a generally circular shaped cross-section, and the rigidifying fingers are generally rectangular in cross-section, wherein the rigidifying fingers are forced fitted in said transverse cavity portions, with corners of said rigidifying fingers interferingly fitting in said generally circular shaped cross-sectional cavity portions.

11. The connector of claim 9, wherein said memory module contacts include a retention portion for retaining the contact in said associated contact receiving cavity.

12. The connector of claim 1, wherein said contact receiving cavities open onto said board-mounting face.

13. An electrical connector of the type for receiving a memory module, the connector comprising:

an electrical connector housing having a board mounting face and a module receiving face, the module receiving face including a slot for receiving a memory module, and contact receiving cavities flanking said slot, at least some of said contact receiving cavities comprising openings positioned adjacent said slot, and transverse cavities offset from said openings;

electrical terminals for receipt in said cavities, each said terminal including a memory module contact facing, and partially overlapping, said slot, and said terminals including compliant printed circuit board connecting portions, at least some of said compliant printed circuit board connecting portions being staggered laterally away from said slot to stagger adjacent compliant printed circuit board connecting portions, the staggered compliant printed circuit board connecting portions being connected to said memory module contacts by way of a tail portion, and said electrical terminals including at least one rigidifying finger adjacent to said compliant pin portion, for rigidifying said compliant printed circuit board connecting portions during insertion of said connector into a printed circuit board, said at least one rigidifying finger upstands in the plane of said compliant printed circuit board connecting portions beyond the intersection of said compliant printed circuit board connecting portions and said tail portions, the electrical terminals being stamped and formed from a metal material with the tail portions sheared from the material forming said compliant printed circuit board connecting portions, with the rigidifying fingers upstanding in the plane of the material forming said compliant printed circuit board connecting portions, and with a substantial length of said rigidifying fingers positioned in said transverse cavities.

14. The connector of claim 13, wherein the electrical contacts each include two rigidifying fingers flanking the tail portion.

15. The connector of claim 13, wherein the electrical contacts each include a single rigidifying finger, with the tail portion flanking the single rigidifying finger.

16. The connector of claim 13, wherein said housing includes transverse cavity portions to receive said rigidifying fingers.

17. The connector of claim 16, wherein said transverse cavity portions are of a generally circular shaped cross-section, and the rigidifying fingers are generally rectangular in cross-section, wherein the rigidifying fingers are forced fitted in said transverse cavity portions, with corners of said rigidifying fingers interferingly fitting in said generally circular shaped cross-sectional cavity portions.

18. The connector of claim 13, wherein said contact receiving cavities open onto said board-mounting face.

19. The connector of claim 18, further comprising a channel which opens onto said mounting face, and which interconnects said contact receiving cavities and said transverse cavity portions, and receives said tail portions therein.

20. The connector of claim 18, wherein said memory module contacts include a retention portion for retaining the contact in said associated contact receiving cavity.

* * * * *